United States Patent [19]

Smith

[11] Patent Number: 4,677,288

[45] Date of Patent: Jun. 30, 1987

[54] OPTICAL TURRET

[75] Inventor: Eugene A. Smith, Hawthorne, Calif.

[73] Assignee: Northrop Corporation, Hawthorne, Calif.

[21] Appl. No.: 700,788

[22] Filed: Feb. 11, 1985

[51] Int. Cl.[4] ..... F41G 7/00

[52] U.S. Cl. ..... 250/216; 244/3.16

[58] Field of Search ..... 350/6.5, 6.6, 6.7, 6.8, 350/6.91; 250/234, 235, 236, 216; 244/3.16; 356/1.4

[56] References Cited

U.S. PATENT DOCUMENTS

| | | | |
|---|---|---|---|
| 3,804,485 | 4/1974 | Clarke | 350/6.8 |
| 4,024,392 | 5/1977 | Teppo et al. | 250/234 |
| 4,248,495 | 2/1981 | Minoura | 250/235 |
| 4,314,154 | 2/1982 | Minoura et al. | 250/235 |
| 4,433,894 | 2/1984 | Hanson et al. | 350/6.8 |

*Primary Examiner*—David C. Nelms
*Assistant Examiner*—Charles F. Wieland
*Attorney, Agent, or Firm*—Terry J. Anderson; Michael B. Lachuk

[57] ABSTRACT

An optical turret shaped for minimum aerodynamic and aero-optic impact at supersonic speeds. The turret optics includes a common optical element for scanning the optical tracking beam and the projected laser beam to provide for automatic alignment of both beams. Separate windows associated with the tracking beam and the laser output beam is provided for increased efficiency, the window material in each window being compatibel with the optical wavelengths passing therethrough.

12 Claims, 7 Drawing Figures

FIG. 1
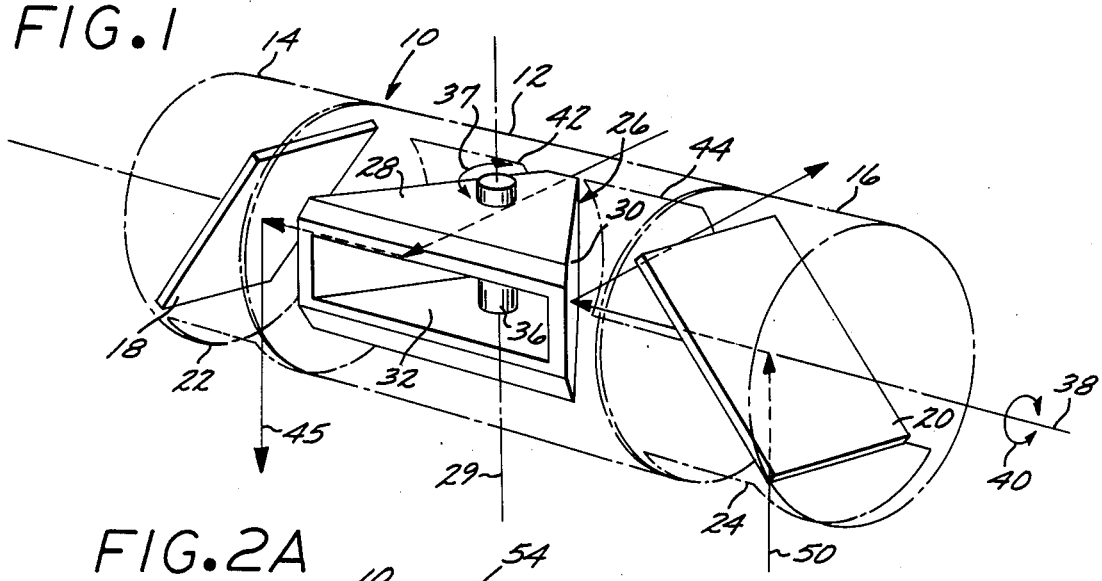
FIG. 2A
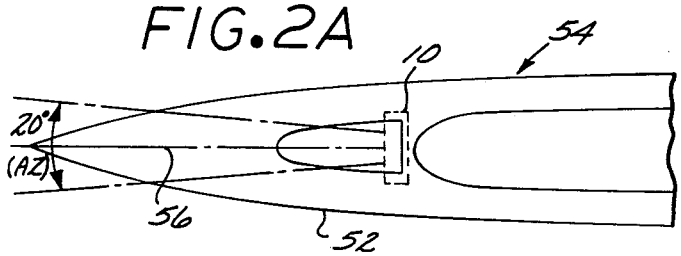
FIG. 2B
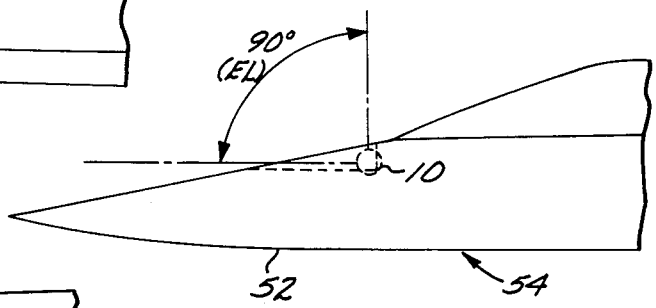
FIG. 4A
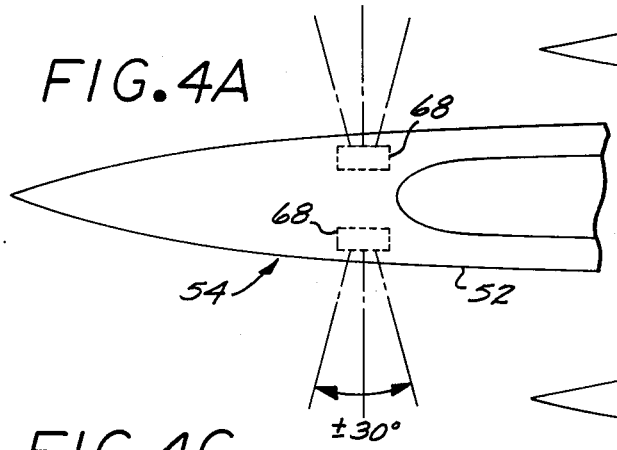
FIG. 4B
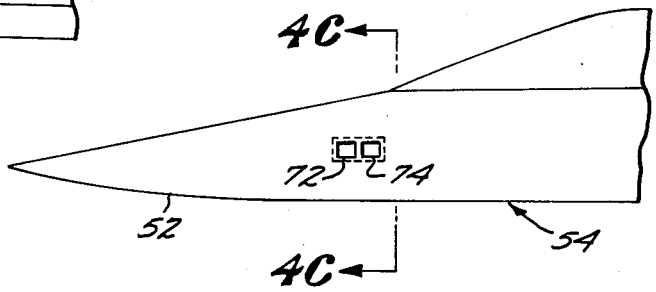
FIG. 4C
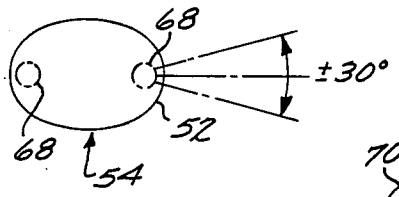
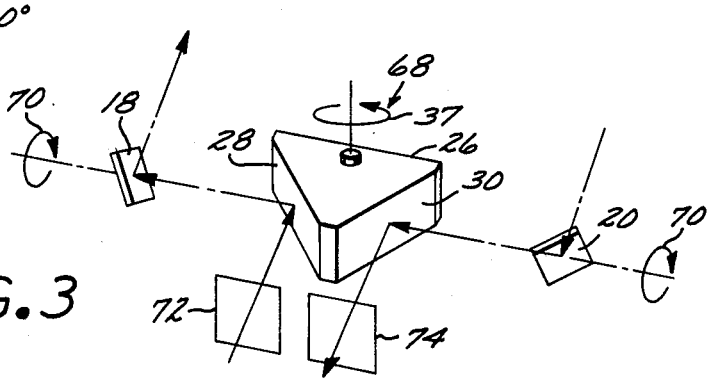
FIG. 3

OPTICAL TURRET

BACKGROUND OF THE INVENTION

1. Field of the Invention The present invention provides an improved optical turret particularly adapted for use in aircraft. The turret includes a common optical element for scanning the tracker and output laser beams. Separate windows are provided adjacent to the common optical element for separately transmitting the tracking and output beams.

2. Description of the Prior Art

Laser systems, such as weapons, typically employ one optical wavelength for tracking a target and a different wavelength for the projected beam. The optical tracking wavelength is generally sufficiently different from the optical wavelength of the projected beam to insure that one does not interfere with the other. The output optics for transmitting/receiving the tracking and projected beams (referred to in the art as tracking-/pointing functions) is generally housed in a turret located on the aircraft. The use of a common window material could result in unacceptable losses for either the tracker or the projected beam; for example, with output optics for long IR tracking wavelengths (such as 10.6 microns) together with visible and near-infrared beam wavelengths. In order to reduce the losses, it has been determined that two separate window areas associated with the turret had to be provided to efficiently handle both the tracking/pointer functions.

Although various optical systems could be designed to transmit the tracker and beam wavelengths out through the turret, certain design constraints placed on the turret, particularly in the case of a high speed aircraft, require that the turret be compactly designed and be compatible with supersonic speeds. In essence, what is necessary is to provide a turret having a design such that the configuration and size of the output optics therein minimize aerodynamic and aero-optic impact at supersonic speeds.

SUMMARY OF THE PRESENT INVENTION

The present invention provides an improved turret designed for use in an aircraft, the turret being designed to be compact and lightweight in order to minimize the aerodynamic/aero-optic impact of the aircraft at supersonic speeds. In particular, the turret optics incorporates a rotatable common optical element for scanning the tracking and output beams, the common optical element being supported in a central drum portion rotably mounted between two fixed end portions. Rotation of the common optical element and the central portion causes the tracking and output beams to be scanned in both azimuth and elevation. In one embodiment wherein large elevation angles are required, two separate drum mounted window areas are provided, one for the tracking beam and one for the output beam. In a second embodiment, body mounted windows for smaller elevation angles or for beam switching are provided adjacent the common optical element. The drum torquer device can be mounted external to the drum and the common optical element torquer can be mounted on (or in) the drum or the common optical element. In a preferred embodiment, an internal portion of the common optical element is removed to reduce the weight thereof, thereby providing a low inertia element for fast response times.

The utilization of a common optical element as described hereinabove instead of a more complicated optical system reduces the turret weight and size and provides a more cost effective configuration than are currently available. Since the tracking beams and output beams are reflected from the same rotating optical element, fixed alignments in the drum rotation axis is provided. The turret optics can be positioned on the aircraft in various arrangements depending on the particular requirements for that aircraft. The invention is useful either as part of a laser communication system or a laser weapon system.

BRIEF DESCRIPTION OF THE DRAWINGS

For a better understanding of the invention as well as other objects and further features thereof, reference is made to the following description which is to be read in conjunction with the accompanying drawings wherein:

FIG. 1 shows one embodiment of the turret of the present invention wherein the tracking and beam windows are formed in the turret;

FIGS. 2(*a*) and 2(*b*) illustrate the positioning of the turret shown in FIG. 1 in a particular location in a small fighter aircraft;

FIG. 3 illustrates another version of the turret design wherein the tracking and beam windows are fixed windows in the aircraft fuselage; and FIGS. 4(*a*)–4(*c*) illustrate the positioning of the turret shown in FIG. 3 in a small fighter aircraft.

It should be noted that the same reference numerals identify identical components in each of the figures.

DETAILED DESCRIPTION OF THE INVENTION

FIG. 1 illustrates in a simplified form one embodiment of the turret 10 of the present invention typically utilized in fighter aircraft. Turret 10 comprises a rotating central drum portion 12 and two adjoining fixed end portions 14 and 16. The fixed end portions 14 and 16 are typically secured in the installation in which the turret is to be mounted as in the small fighter aircraft shown in FIGS. 2 and 4. A beam turning mirror 18 is positioned in the fixed end portion 14 (specific mounting arrangement is not illustrated) and turning mirror 20 (specific mounting arrangement not illustrated) is located in the fixed end portion 16. A tracking port 22 is also formed in fixed end 14 to allow the passage of the tracking beam to the tracking sensors (not shown). Similarly, an output beam port 24 is incorporated in the fixed end 16 to allow the output laser beam from the laser generator to be transmitted to the target. Mounted within the rotating central drum 12 is a rotating common optical member 26, typically shaped as the triangular element illustrated. Optical member 26 incorporates at least two surfaces 28 and 30 adapted to reflect optical rays incident thereon. In the embodiment illustrated the triangular element 26 has a hollowed out portion 32 to reduce the overall weight of the element 26 thus lowering the inertia thereof and allowing for a faster response to tracker data information. In the embodiment illustrated, only surfaces 28 and 30 are used to reflect beams incident thereon. A shaft 36 from a torquer device (not shown) is utilized to rotate the optical element 26 in the alternating directions indicated by arrow 37. The drum torquer (not shown) is mounted external to the drum 12 and is utilized to rotate the drum about the drum roll (elevation) axis 38 in the alternative direction indicated by arrow 40. Since the output optics in the turret 10 accommodate significantly differing tracking and beam wavelength, it has been determined that two separate window areas of differing material should be utilized in the embodiment illustrated in FIG. 1 for maximum optical efficiency. In the preferred arrangement, two separate spaced apart drum mounted windows 42 and 44 are provided for the tracking beam and output beam, respectively. In general, the drum mounted windows are utilized for large elevation angles and typically body mounted windows, as shown in the embodiment of FIG. 3, is utilized for smaller elevation angles and/or for beam switching purposes (redirecting the beam, or tracking ray, from one window output set to another window output set mounted on a different portion of the aircraft body). Although beam windows 42 and 44 are shown on separate spaced apart component parts, a single window comprised of two different materials to accommodate the separate beams can be provided instead. Alternatively, two separate windows of differing material but positioned adjacent to each other may also be utilized. Further, if a single window material was compatible with both beam and tracker wavelengths, a single window of that material could replace the two separate materials. Window materials, it should be noted, can be any of the many optically transparent materials.

In a typical operation, a low power laser device (not shown) generates a tracking (or designator) beam which is directed through tracker port 22 and is turned by mirror 18 to be reflected onto surface 28 of optical element 26. Typically, as shown in FIG. 2, the common optical element 26 is rotated back and forth about axis 29 a total of X degrees (for example 10°) such that the total azimuth field-of-fire is approximately 2X degrees (or 20°). Rotating the drum 12 about axis 38 provides an elevation field of view, 90° for the embodiment shown in FIG. 2. The tracking (or designator) beam reflected off surface 28 in turn is transmitted through window 42 and utilized to illuminate a spot on a target initially located by another sensor such as a radar system (not shown). The reflected tracking beam or ray is then transmitted through the window 42, reflected from surface 28 and mirror 18 such that the reflected ray 45 is returned to tracking sensors located in the aircraft. Although not illustrated in the figure, aircraft device electronics respond to the tracking ray input and operates to rotate the central drum 12 and the optical element 26 a sufficient amount so that the location of the illuminated spot corresponds to the aimpoint for the laser output beam generated by the aircraft laser device. In particular, the output beam 50 generated by the device is reflected from mirror 20 onto surface 30 of optical element 26 and then transmitted through window 44, the output beam being directed onto the target so that the target is irradiated by the main beam. Passive tracking (without the designator beam) is also compatible with this invention. Referring now to FIGS. 2A and 2B, the turret 10 in FIG. 1 is shown mounted in the fuselage 52 of aircraft 54 and aligned with the longitudinal axis of aircraft 54.

FIG. 3 shows another embodiment 68 of the basic turret design shown in FIG. 1. As in the embodiment shown in FIG. 1, the single optical element 26 is rotable in the direction of arrow 37 by shaft 36 and is provided to reflect the tracker and output beams from surfaces 28 and 30, respectively. Rotation of optical element 26 by shaft 36 provides for beam steering in the azimuth axis as described hereinabove with reference to FIG. 1. In order to provide for the scanning in elevation, a torquer device (not shown) is provided to rotate the optical element 26 in the direction of arrow 70. Mirrors 18 and 20 are mounted (mounting arrangement not illustrated) in a common configuration within the aircraft 52. In the embodiment shown in FIG. 3, the tracker and beam windows 72 and 74 respectively, are mounted in the side of the fuselage 52 as shown in FIGS. 4A and 4B. As noted hereinabove, body, or fuselage, mounted windows are generally utilized with a relatively small elevation angle or for reasons of beam switching. As shown in FIGS. 4A and 4B, typically the elevation angle ranges from ±30° in comparison to the elevation of 90° shown in FIG. 2B. A typical azimuth angle of ±30° is illustrated in FIG. 4A. FIGS. 4A and 4C illustrate the utilization of two separate turrets 68 in aircraft 54.

Other arrangements for the turret can be provided such as placing the turret optics within the rotating nose of the aircraft or mounted to the aircraft wing-tip pod. The important feature which is common to each of the configurations is the use of a common optical element for the output and tracker beams which, this feature enabling both beams to be in alignment throughout target tracking and beam firing operations.

It should be noted that the sizes of the windows increase in the beam deflection angle increases. Similarly, the size of the common optic mirror surfaces also increase as deflection angle requirements about axis of rotation 12, FIG. 1 are increased.

The present invention thus provides a turret designed for reduced aerodynamic and aero-optic impact due to its smaller size and compactness relative to other turret designs by using the common optical element within the turret, the overall size of the turret configuration being substantially reduced thus making the turret design compatible with lower drag installations and with smaller size fighter aircraft. The weight of the common optical element can be reduced by removing material from the center of the common optical element since only two of the mirror surfaces are required for use. The common optical element, it should be noted, can be made from a variety of optical mirror materials (such as glass, plastic, metal) with coatings appropriate to the wavelengths being reflected and either active or passive cooling can be provided as appropriate. The lower weight and inertia of the common optical element thus allows for faster response to tracking signals. The use of a common optical element in the turret is cost effective since more complicated optical systems are not required and is compatible with the two window system as disclosed or a single window system if the latter configuration is acceptable for particular fighter aircraft applications.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt to a particular situation or material to the teaching of the invention without departing from its essential teachings.

What is claimed is:

1. An optical system for use in an aircraft and responsive to a first and a second optical beams incident thereon comprising:

a support structure having a middle portion rotatable with respect to opposite end portions of the support structure about a central longitudinal axis of the support structure;

a first mirror member directing a first incident optical beam propagating along an axis perpendicular to the support structure central longitudinal axis into a reflected beam propagating along said central axis;

a rotatable optical member having first and second reflecting surfaces thereon and positioned for rotation about an axis perpendicular to the support member central axis, said optical member being supported within the rotatable middle portion of the support structure, wherein the rotatable optical member is rotatable about two perpendicular axes;

a second mirror member directing a second incident optical beam propagating along an axis perpendicular to the support structure central axis into a reflected beam propagating along said central axis in a direction opposite the reflected beam of the first mirror member; and window means positioned adjacent said rotatable optical member, wherein the first and second incident beams, initially propagating along axes parallel to one another and perpendicular to the support structure central axis, are respectively reflected of the first and second mirror members so as to propagate in opposite directions generally along the support structure central axis towards the rotatable optical member and are subsequently reflected off the rotatable optical member so as to propagate along generally parallel axes.

2. The optical system of claim 1 wherein said optical member comprises a rotatable triangular mirror structure.

3. The optical system of claim 1 wherein an interior portion of said optical member has been removed.

4. The optical system of claim 1 wherein said window means comprises first and second window portions having differing transmissive characteristics.

5. The optical system of claim 1 wherein said second optical beam comprises a tracking beam.

6. The optical system of claim 1 wherein the second incident optical beam is generated by a laser device.

7. The optical system of claim 1 wherein said first and second incident optical beams are of a different wavelength.

8. The optical system of claim 1 wherein said first mirror member is mounted in one end of the support structure and said second mirror member is mounted in an opposite end of the support structure.

9. The optical system of claim 4 wherein said first and second window portions are mounted on the middle rotatable portion of the support structure.

10. The optical system of claim 9 wherein said first and second window portions are spaced from each other.

11. A combined target imaging and target designating optical system, comprising:

a support structure having fixed first and second end portions and a middle portion disposed between and rotatably coupled to the fixed end portions, said middle portion rotating about an axis generally coaxial with a central longitudinal axis of the support structure; and a rotatable beam steering element pivotally mounted within the support structure middle portion and rotating about an axis generally perpendicular to the support structure central longitudinal axis, said steering element having first and second reflecting surfaces respectively steering first and second incident optical beams, initially propagating in opposing directions along axes generally parallel to the support structure central longitudinal axis, along generally parallel beams propagating away from the optical system, wherein the steering element is rotated about two perpendicular axes and provides both azimuthal and elevational beam steering to the first and second incident optical beams.

12. The optical system of claim 11 further comprising first and second mirrors respectively mounted within the support structure first and second fixed end portions and respectively directing first and second optical beams propagating along parallel axes generally perpendicular to the support structure longitudinal axis to form the first and second incident optical beams propagating in opposing directions generally parallel to the support structure central longitudinal axis.

* * * * *